US010666005B2

(12) United States Patent
Saint-Michel

(10) Patent No.: US 10,666,005 B2
(45) Date of Patent: May 26, 2020

(54) HIGH-VOLTAGE ELECTRICAL SWIVEL

(71) Applicant: EURO TECHNIQUES INDUSTRIES, Gemenos (FR)

(72) Inventor: Laurent Saint-Michel, Aubagne (FR)

(73) Assignee: EURO TECHNIQUES INDUSTRIES, Gemenos (FR)

( * ) Notice: Subject to any disclaimer, the term of this patent is extended or adjusted under 35 U.S.C. 154(b) by 214 days.

(21) Appl. No.: 15/925,176

(22) Filed: Mar. 19, 2018

(65) Prior Publication Data

US 2018/0269642 A1 Sep. 20, 2018

(30) Foreign Application Priority Data

Mar. 20, 2017 (FR) ..... 17 52293

(51) Int. Cl.
*H01R 39/64* (2006.01)
*H01R 39/48* (2006.01)
*H01R 35/00* (2006.01)

(52) U.S. Cl.
CPC ..... *H01R 39/64* (2013.01); *H01R 35/00* (2013.01); *H01R 39/48* (2013.01)

(58) Field of Classification Search
CPC ..... H01R 39/64; H01R 35/00; H01R 39/48; H01R 4/4881; H01R 13/523; H01R 35/04; H01R 13/53
USPC ..... 439/28, 24–25
See application file for complete search history.

(56) References Cited

U.S. PATENT DOCUMENTS

| | | | | |
|---|---|---|---|---|
| 4,142,767 | A | 3/1979 | Karl et al. | |
| 4,252,388 | A | 2/1981 | Brady | |
| 6,612,847 | B2 * | 9/2003 | Canizales, Jr. | H01R 39/643 439/17 |
| 7,137,822 | B1 | 11/2006 | Longmire et al. | |
| 9,130,330 | B2 * | 9/2015 | Menardo | B63B 21/00 |
| 9,515,443 | B2 * | 12/2016 | Murris | H01R 39/64 |
| 2004/0100159 | A1 | 5/2004 | Rehder et al. | |
| 2011/0237089 | A1 | 9/2011 | Berard et al. | |

FOREIGN PATENT DOCUMENTS

JP S61-277182 12/1986

OTHER PUBLICATIONS

International Search Report, FR 1752293; dated Nov. 6, 2017.

* cited by examiner

*Primary Examiner* — Edwin A. Leon
(74) *Attorney, Agent, or Firm* — Young & Thompson

(57) ABSTRACT

A high voltage electrical swivel includes a first part and a second part, which are mobile relative to each other and form a closed internal chamber, each of the two parts including at least one electrical connector; and at least one electrical track electrically linked to a connector of one of the two parts and at least one brush assembly electrically linked to a connector of the other of the two parts, the at least one brush assembly cooperating with the at least one electrical track to establish an electrical contact, the at least one electrical track and the at least one brush assembly being housed in the closed internal chamber. The closed internal chamber is filled with a dielectric insulating gas having a dielectric strength greater than that of the air surrounding the electrical swivel.

20 Claims, 6 Drawing Sheets

HIGH-VOLTAGE ELECTRICAL SWIVEL

CROSS-REFERENCE TO RELATED APPLICATIONS

This application claims the benefit under 35 U.S.C. § 119(a)-(d) of French Application No. 1752293 and filed on Mar. 20, 2017. The above-cited patent application is incorporated herein by reference in its entirety.

FIELD OF THE INVENTION

The present invention concerns electrical swivels and more particularly high-voltage electrical swivels.

BACKGROUND OF THE INVENTION

An electrical swivel, also termed electrical collector or slip ring joint, is an electro-mechanical device used to transfer electricity between two parts that are mobile relative to each other (one part being considered to be fixed or "geostationary" and the other rotary).

The general principle of such a device relies on the implementation of circular conducting tracks cooperating with mobile brush assemblies in order to establish electrical connections, typically with several electrical phases.

Electrical swivels are commonly used in robotics, in particular on production lines.

They are also used in more specific applications, for example at sea to establish an electrical connection between an underwater device and a ship.

FIG. 1 illustrates such an example of use. As illustrated, an electrical swivel 100 is used here on board a ship 105 to establish an electrical junction between a cable 110 connected to an underwater electrical system (not shown) and a cable 115 connected to an electrical system of the ship 105.

In such an application, referred to as "offshore", the electrical swivel is generally a high-voltage electrical swivel used for voltages greater than 1 500 V for direct current or 1 000 V for alternating current, enabling the transfer of high electrical power between a fixed structure linked to the sea bed and a mobile part such as an FPSO (initialism of Floating Production, Storage and Offloading vessel).

Electrical swivels used in such applications must meet predetermined quality requirements to provide a certain level of security, in particular in an explosive atmosphere.

For such purposes, the electrical swivels implemented generally comprise an internal chamber within which are placed conducting tracks and associated brush assemblies. The internal chamber is filled with a dielectric fluid, typically oil.

The dielectric fluid enables each conducting track to be insulated in order to prevent electrical arcs forming with neighboring conducting parts (generally metal parts) and to reduce the distance between the conducting tracks. More particularly, the minimum distance between the conducting tracks is linked to the dielectric strength of the medium in which they are located, it being possible for the dielectric strength of oil to be ten times higher than that of air (under standard pressure, for example a normal pressure of one atmosphere). It is to be recalled here that the dielectric strength of a material is expressed in kV/mm (kilovolts per millimeter) and characterizes the maximum electric field that may be applied between two different electrodes before an electric arc is produced and therefore breakdown.

However, although the dielectric strength of oil is much greater than that of the air and enables the distances between the conducting tracks to be significantly reduced, these distances are also linked to the electrical voltage at the terminals of the electrical swivel. Thus, for high voltages, the electrical swivels are necessarily of large size and require a high quantity of oil. This results in devices that are heavy and bulky.

The invention enables at least one of the problems set forth above to be solved.

SUMMARY OF THE INVENTION

Embodiments of the invention concern a high-voltage electrical swivel comprising:

- a first part and a second part, which are mobile relative to each other and form a closed internal chamber, each of the two parts comprising at least one electrical connector;
- at least one electrical track electrically linked to a connector of one of the two parts and at least one brush assembly electrically linked to a connector of the other of the two parts, the at least one brush assembly cooperating with the at least one electrical track to establish an electrical contact, the at least one electrical track and the at least one brush assembly being housed in the closed internal chamber;

the closed internal chamber being filled with a dielectric insulating gas having a dielectric strength greater than that of the air surrounding the electrical swivel.

The electrical swivel according to the invention is in particular configured for very high voltage applications, for example applications employing voltages of the order of 180 kV.

It furthermore enables a low maintenance frequency linked to the pollution of the fluid in the internal chamber.

What is more, the dielectric strength of the insulating gas used in the internal chamber of the electrical swivel increases with pressure. Therefore, a heating phenomenon and thus increased pressure occurring inside an electrical swivel improves the dielectric strength of the gas and reduces the risk of breakdown.

According to certain embodiments, the electrically insulating gas has a dielectric strength greater than 40 kV/mm at operating pressure.

According to certain embodiments, the electrically insulating gas comprises at least one of the following gases:

- a gas of the fluoronitrile family,
- sulfur hexafluoride, and
- trifluoroiodomethane.

According to certain embodiments, the electrical swivel further comprises at least one connector mounting of cylindrical form of which an interior part opens onto the closed internal chamber, one of the electrical connectors being mounted on the at least one connector mounting.

According to certain embodiments, the swivel further comprises at least one valve for venting and/or filling mounted on the at least one connector mounting.

According to certain embodiments, the at least one valve for venting and/or filling comprises a safety means for indicating an open position.

According to certain embodiments, the swivel further comprises at least one conductor electrically linking at least one connector to at least one brush.

According to certain embodiments, the at least one conductor holds the brush assembly in a predetermined position.

According to certain embodiments, the swivel further comprises at least one sensor allowing values to be measured of at least one parameter relative to the quality of the dielectric insulating gas with which the swivel is filled.

According to certain embodiments, the first part comprises at least one first electrical track electrically linked to at least one electrical connector of the first part and at least one second electrical track electrically linked to at least one grounding member of the first part, and the second part comprises at least one first brush assembly electrically linked to at least one electrical connector of the second part, cooperating with the at least one first conducting track to establish an electrical contact, and at least one second brush assembly electrically linked to at least one grounding member of the second part, cooperating with the at least one second conducting track to establish an electrical contact.

BRIEF DESCRIPTION OF THE DRAWINGS

Other advantages, objects and features of the present invention will emerge from the following detailed description, given by way of non-limiting example, relative to the accompanying drawings in which:

FIG. 11, comprising

DETAILED DESCRIPTION OF THE PREFERRED EMBODIMENTS

The inventors have observed that in an electrical swivel having an internal chamber filled with dielectric oil, comprising conducting tracks and associated brush assemblies, there is a risk of breakdown or of short-circuit which increases over time.

This phenomenon is in particular due to pollution of the oil, which leads to a reduction in its dielectric strength. This pollution results from the progressive accumulation of multiple particles suspended in the oil, caused by wear of the moving parts, mainly the brushes. It also results from the occurrence of partial electrical discharges in the internal chamber of the swivel. The partial electrical discharges may also be due, for example, to the presence of defects, air bubbles or water bubbles. They consist of a start of electrical conduction localized in the insulating part, which does not fully short-circuit the insulation. These partial discharges lead to degradation of the dielectric oil and of its dielectric strength by carbonization.

According to particular embodiments of the invention, an electrical swivel is provided with a closed internal chamber comprising conducting tracks and associated brush assemblies, this chamber being at least partially filled with a dielectric insulating gas having a dielectric strength greater than that of the air (for the same pressure), for example a dielectric strength twice that of the air in similar implementation conditions.

The gas contained in the internal chamber is preferably under pressure, for example a pressure of a few bars, for example 7 bars. The gas is chosen so as to provide a high dielectric strength, for example a dielectric strength greater than 40 kV/mm at operating pressure (for example 7 bars), in order to allow its use with very high voltages and/or in the form of compact devices.

It is noted here that as a gas is by principle volatile, possible deteriorations caused by partial electrical discharges, which alter the dielectric capacities of the gas at a given location, do not remain stationary. Thus, the critical zones causing the partial discharges have a much greater chance of having the dielectric medium renewed, in comparison with the dielectric oil. Furthermore, as the gas has a higher dielectric strength than the oil, the probability of partial discharges occurring is lower.

Figure 1:
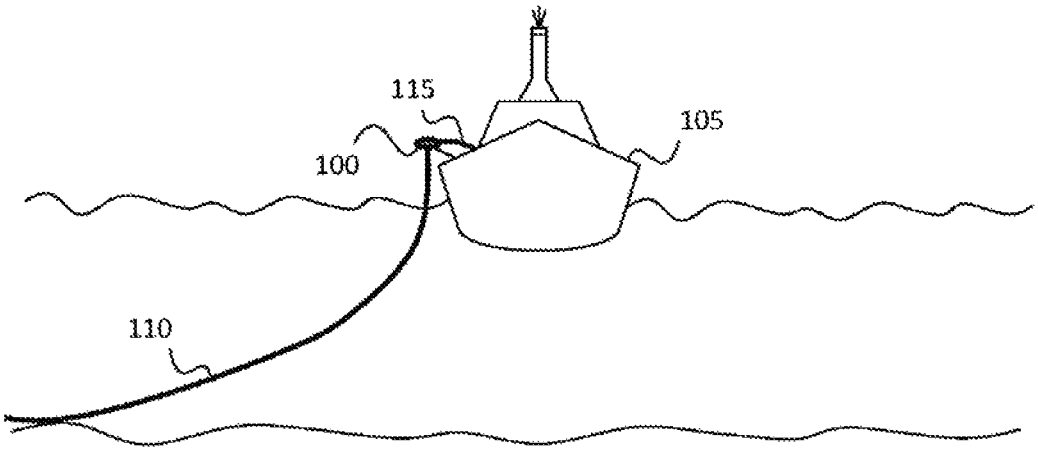
Figure 1 (Prior art)
FIG. 1, already described, illustrates an example of use of an electrical swivel on board a ship.
Figure 2:
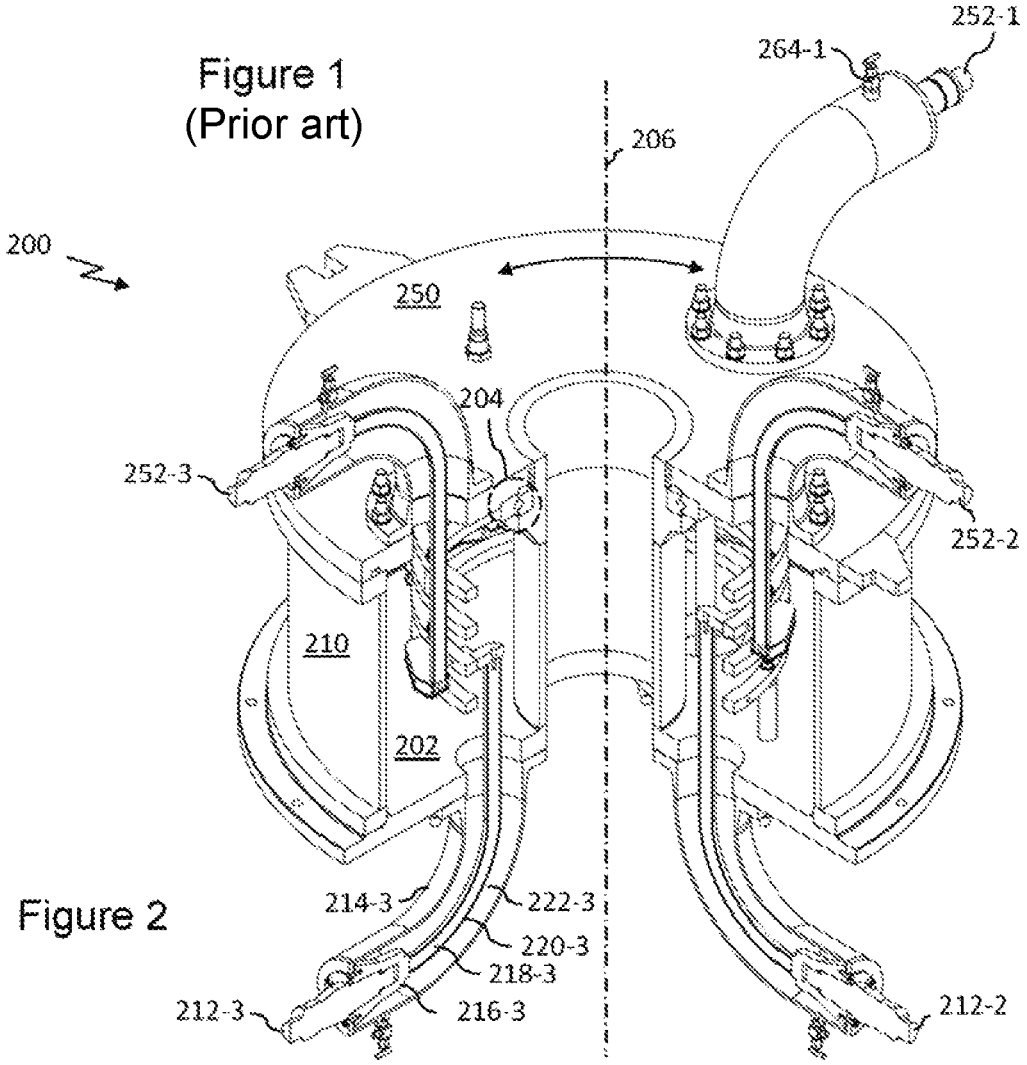
FIG. 2 is a cut-away view of an electrical swivel example according to an embodiment of the invention.

FIG. 2 is a cut-away view of an example of an electrical swivel 200 according to an embodiment of the invention. As illustrated, the electrical swivel 200 comprises two parts 210 and 250, which are mobile relative to each other. It is considered here that part 210 is the fixed or geostationary part while part 250 is mobile, typically rotary. Of course, part 210 could be mobile and part 250 could be fixed.

By way of illustration, the electrical swivel has the purpose here of connecting three electrical phases. It thus comprises three connectors referenced 212-1, 212-2 and 212-3 on the fixed part (connector 212-1 being hidden here) and three connectors referenced 252-1, 252-2 and 252-3 on the mobile part. These connectors may in particular be produced, entirely or partly, from copper.

It should be understood that the number of connectors of the fixed part and of the mobile part may be less than three or greater than three. Similarly, the number of connectors of the fixed part may be different from the number of connectors of the mobile part, it being possible for a connector to be linked to several conducting tracks or to several brushes or, conversely, for one conducting track or brush to be linked to several connectors.

Each connector is mounted on a connector mounting here taking the form of a bent cylinder. Other forms may be envisioned. The connector mountings are advantageously hollow and each protect a conductor that is preferably provided with an insulating sheath to limit the risk of electrical arcs (and/or to improve the compactness of the device). This conductor, for example entirely or partly formed from copper, is electrically connected to a conducting track or to a brush. It may furthermore play a structural role, in particular to hold (or contribute to holding) a conducting track or a brush assembly in a given position. It may for example be a rod of round or square cross-section. A space is present between the conductor or the insulating sheath and the wall of the connector mountings. This space is in communication with the internal chamber 202 of the electrical swivel by one of the ends of each connector mounting. The other end is closed by the corresponding connector (which is electrically linked to the conductor protected by the connector mounting), the connector being moreover insulated from the support by an insulating ring.

Thus, for example, the connector 212-3 is mounted on the connector mounting 214-3 by means of the insulating ring 216-3. The connector is electrically linked to the conductor 218-3 provided with an insulating sheath 220-3. The space 222-3 is in communication with the internal chamber 202. The connector mounting 214-3 is mechanically connected to the fixed part 210, for example using bolts (not shown).

Although, for reasons of clarity, the connectors are oriented outwardly of the electrical swivel, other orientations may be used. In particular, all the connectors may be oriented in a same direction.

As illustrated, the electrical swivel comprises an internal chamber 202 in which are arranged four conducting tracks mechanically connected to the fixed part 210, as well as four groups of brush assemblies fastened to the mobile part 250. A higher or lower number of conducting tracks and/or of groups of brush assemblies may be employed.

The internal chamber 202 is filled with a dielectric gas having a dielectric strength greater than that of ambient air.

The four conducting tracks have here the form of rings disposed in parallel planes, at predetermined distances linked to the dielectric strength of the gas used. They may in particular be produced, entirely or partly, from copper.

A first assembly constituted by a first conducting track and by a first group of brush assemblies is used to establish an electrical connection between members of the fixed part 210 and members of the mobile part 250. This is a grounding connection.

A second assembly constituted by a second conducting track and by a second group of brush assemblies is used to establish an electrical connection between a first connector of the fixed part 210 and a first connector of the mobile part 250, for example between the connectors 212-1 and 252-1. Similarly, a third assembly constituted by a third conducting track and by a third group of brush assemblies is used to establish an electrical connection between a second connector of the fixed part 210 and a second connector of the mobile part 250, for example between the connectors 212-2 and 252-2. Similarly, a fourth assembly constituted by a fourth conducting track and by a fourth group of brush assemblies is used to establish an electrical connection between a third connector of the fixed part 210 and a third connector of the mobile part 250, for example between the connectors 212-3 and 252-3.

It should be understood here that an assembly used to establish an electrical between a connector of the fixed part and a connector of the mobile part may comprise several conducting tracks and several groups of brush assemblies.

Each brush of a group of brushes is mobile relative to the associated conducting track and makes it possible to establish an electrical contact between an element connected to the conducting track and an element connected to the brush. Several brushes may be used to establish an electrical contact with a same conducting track.

According to the embodiment illustrated here, the brushes are in contact with the outside surfaces of the conducting tracks. According to other embodiments, the contacts may be made with other surfaces (upper, lower or inside). It is also possible to establish contacts with several surfaces.

A mechanism 204 such as a ball bearing or a roller bearing enables the mobile part 250 to turn relative to the fixed part 210, around the axis 206 as illustrated with the arrows.

The gas used to fill the internal chamber 202 may in particular be characterized by its dielectric properties, in particular by a breakdown voltage determined according to a pressure and a distance between the electrodes. It is a gas of which the dielectric strength is greater than that of the ambient air.

Figure 3:
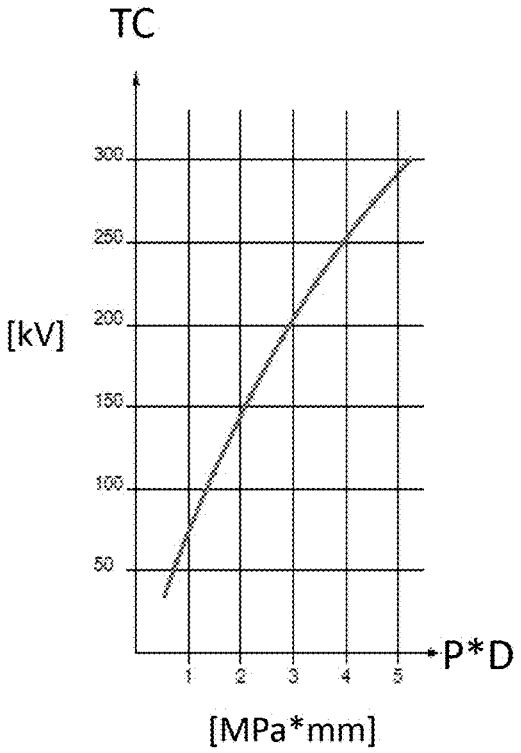
FIG. 3 illustrates properties of a gas able to be used as insulator in an internal chamber of an electrical swivel in accordance with the invention.

FIG. 3 illustrates properties of a gas able to be used as insulator in an internal chamber of an electrical swivel in accordance with the invention. The y-axis represents a breakdown voltage (expressed here in kilovolts, kV) whereas the x-axis corresponds to the product of the pressure (P) of the gas (expressed in Mega Pascals, MPa) and the distance (D) between the electrodes giving rise to the breakdown (expressed in millimeters, mm). The illustrated curve represents an order of magnitude of the breakdown voltage that the insulating gas should preferably possess.

Furthermore, this gas preferably has a capacity to extinguish electrical arcs, a low boiling point (preferably negative) and a high heat transfer coefficient. The capacity to extinguish electrical arcs may be defined as the capacity of the medium to rapidly resume its dielectric strength after the formation of an electrical arc in order that the arc does not persist. It may in particular result from the replacement of the medium where the electrical arc occurred, for example by convection of the gas. It may also result from a drop in temperature in order to reduce the ionization of the medium (for this purpose, the gas used must possess a high heat transfer coefficient to evacuate the heat). Lastly, it may result from a chemical decomposition by the electrical arc into electrically neutral compounds, this decomposition using a high amount of energy, which tends to terminate the electrical arc.

Such gases are generally more dense than air.

It may, for example, be a gas comprising a high proportion, for example more than 50, 75 or 90 percent by volume, of the gas distributed by the company 3M under the name Novec 4710 (3M and Novec are trademarks), of the family of fluoronitriles, of the gas $SF_6$ (sulfur hexafluoride) or of the gas $CF_3I$ (trifluoroiodomethane).

Figure 4:
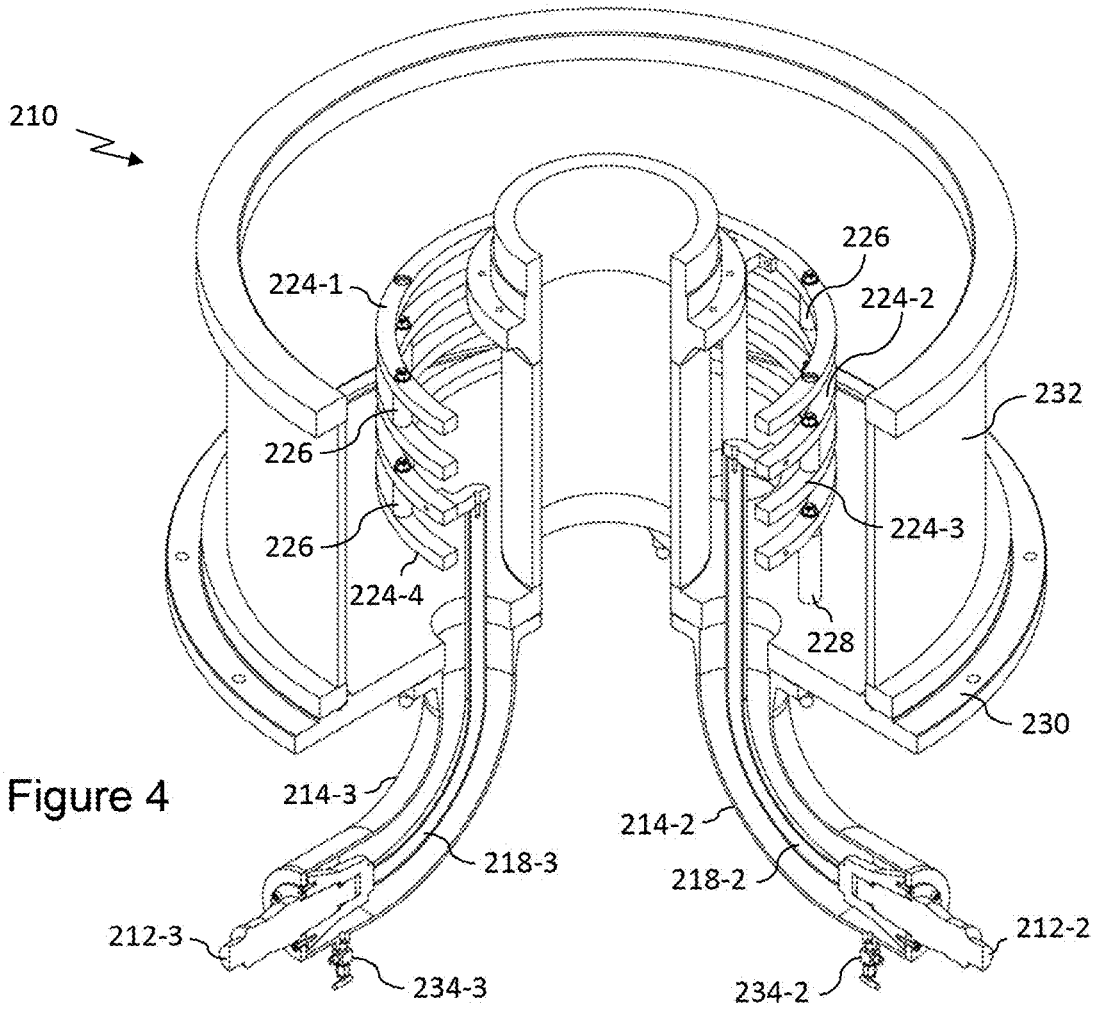
FIGS. 4 and 5 illustrate, in perspective and in longitudinal cross-section, respectively, the fixed part of the electrical swivel shown in FIG. 2.
Figure 5:
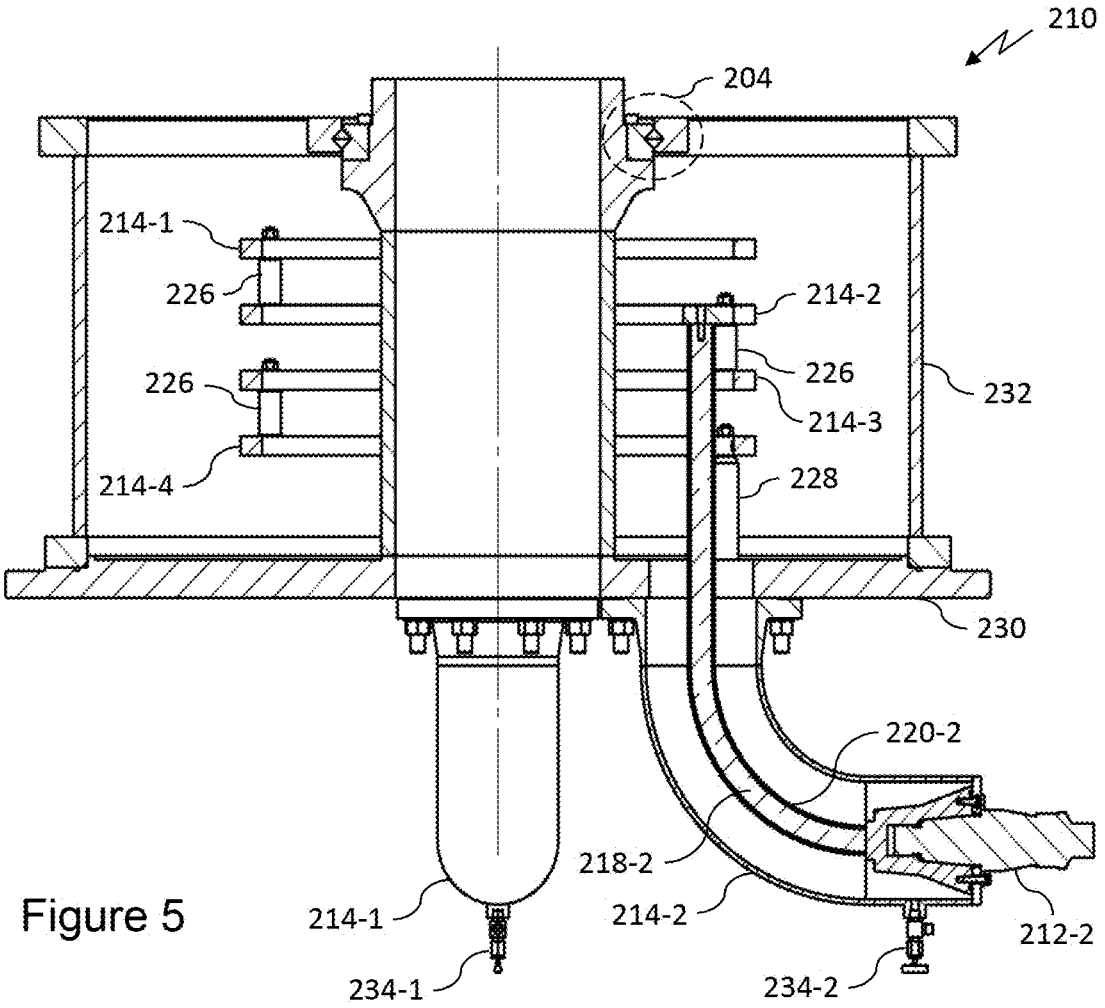

FIGS. 4 and 5 illustrate, in perspective and in longitudinal cross-section, respectively, the fixed part 210 of the electrical swivel 200 shown in FIG. 2.

As described above, the fixed part 210 comprises in particular three connectors 212-1 to 212-3 (the connector 212-1 being hidden in FIG. 4), three connector mountings 214-1 to 214-3 (connector mounting 214-1 being hidden in FIG. 4) and four conducting tracks, referenced here 224-1 to 224-4.

The connector 212-1 is electrically linked to the conducting track 224-1 via a conductor 218-1 (not shown), the connector 212-2 is electrically linked to the conducting track 224-2 via the conductor 218-2 and the connector 212-3 is electrically linked to the conducting track 224-3 via the conductor 218-3.

The fixed part 210 further comprises several insulating mountings 226 for conducting tracks and one or more conducting mountings 228 for conducting tracks. These mountings enable the conducting tracks to be mechanically connected to the body of the fixed part 210, the body here comprising an internal component 230 and an external component 232. These components may, for example, be formed from steel. The conducting mountings 228 for conducting tracks are advantageously provided with an insulating sheath to reduce the risk of electrical arcs (and/or to improve the compactness of the device).

As illustrated, at least one conducting support 228 for conducting tracks is used to mechanically connect the conducting track 224-4 to the internal component 230 and to establish an electrical link between the conducting track 224-4 and the internal component 230. Several insulating mountings 226 are used here to mechanically connect the conducting tracks 224-1 to 224-4 together. Other insulating supports may be used to mechanically connect the conducting tracks 224-1 to 224-4 to one or more elements of the fixed part 210, for example the internal component 230 and/or to the external component 232.

The order of the conducting tracks may be different from that illustrated.

The internal component 230 and the external component 232 form the envelope of the electrical swivel 200 and isolate the electrical part from the outside environment. These components are solids of revolution. By way of example, they may be assembled together by means of suitably configured screw-threaded fasteners, preferably on either side of a seal as described with reference to FIG. 12.

According to a particular embodiment, the internal component 230 comprises an interface to receive the mechanism 204 which itself fulfills the role of interface with the mobile part 250.

Still according to a particular embodiment, the fixed part 210 comprises one or more valves for venting and/or filling. According to the example illustrated in FIGS. 4 and 5, each connector mounting comprises a valve for venting and/or filling. Thus, as illustrated, the connector mounting 214-1 comprises the valve for venting and/or filling 234-1, the connector mounting 214-2 comprises the valve for venting and/or filling 234-2 and the connector mounting 214-3 comprises the valve for venting and/or filling 234-3.

The valves for venting and/or filling are advantageously positioned so as to correspond, at the time of a venting or filling operation, to the highest or lowest positions of the cavity formed by the internal chamber of the electrical swivel and the spaces of the connector mountings, in order to optimize the venting or the filling.

These venting and/or filling valves are advantageously made secure and/or are provided with a detection mechanism making it possible to signal, for example with an audible signal, an open position to advise of any gas leakage.

Figure 6:
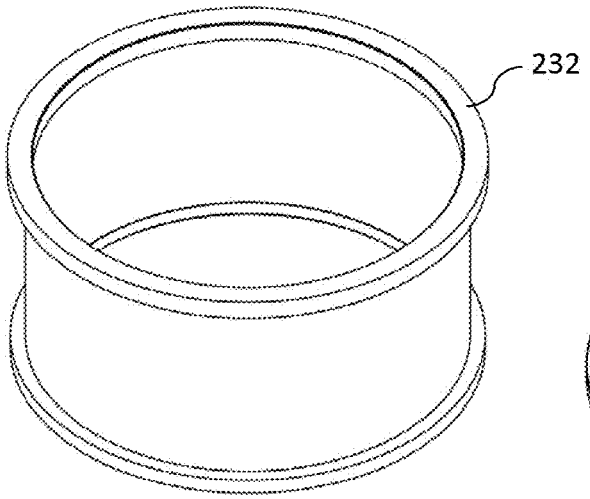
FIGS. 6 and 7 illustrate an internal component and an external component, respectively, of the body of the fixed part of the electrical swivel shown in FIG. 2.
Figure 7:
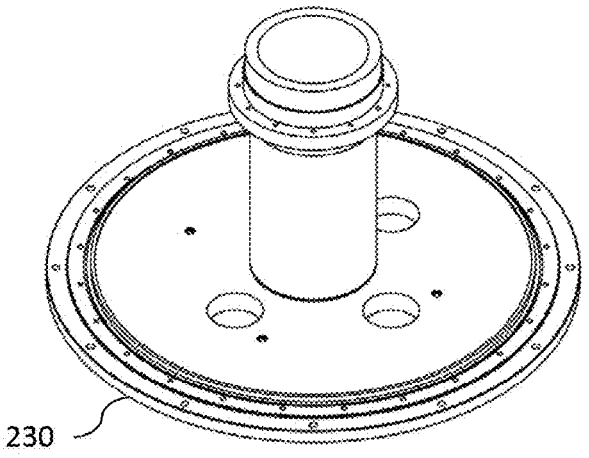

FIGS. 6 and 7 illustrate the internal component 230 and the external component 232, respectively, of the body of the fixed part 210 of the electrical swivel 200 shown in FIG. 2. These two components are mechanically connected to each other using, for example, suitably configured screw-threaded fasteners.

Figure 8:
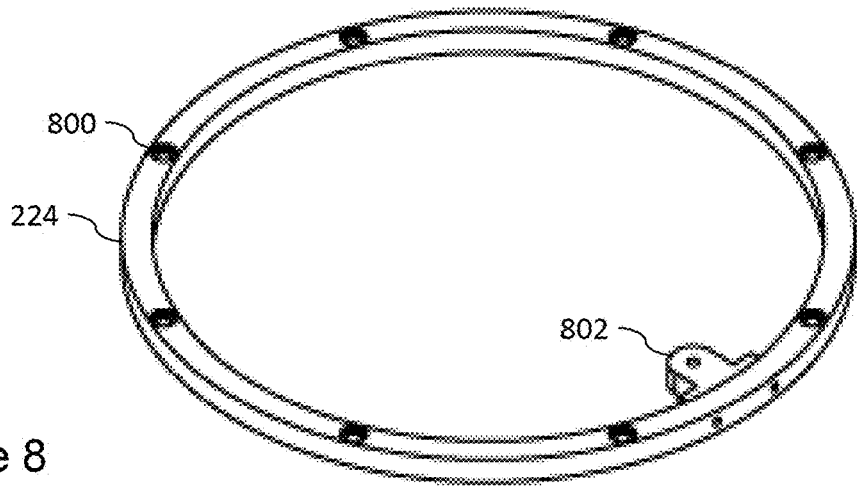
FIG. 8 illustrates an example of a conducting track of the fixed part of the electrical swivel represented in FIG. 2.

FIG. 8 illustrates an example of a conducting track, generically referenced 224, of the fixed part 210 of the electrical swivel 200 shown in FIG. 2.

As illustrated, the conducting track 224 comprises a set of fastening points 800, for example openings, configured for the fastening of insulating mountings. The number of fastening points 800 is variable.

The conducting track 224 comprises one or more fastening points 802, for example projections provided with openings, configured for fastening conducting mountings and/or conductors electrically linked to connectors.

As described above, the conducting track 224 may be produced, entirely or partly, from copper.

Figure 9:
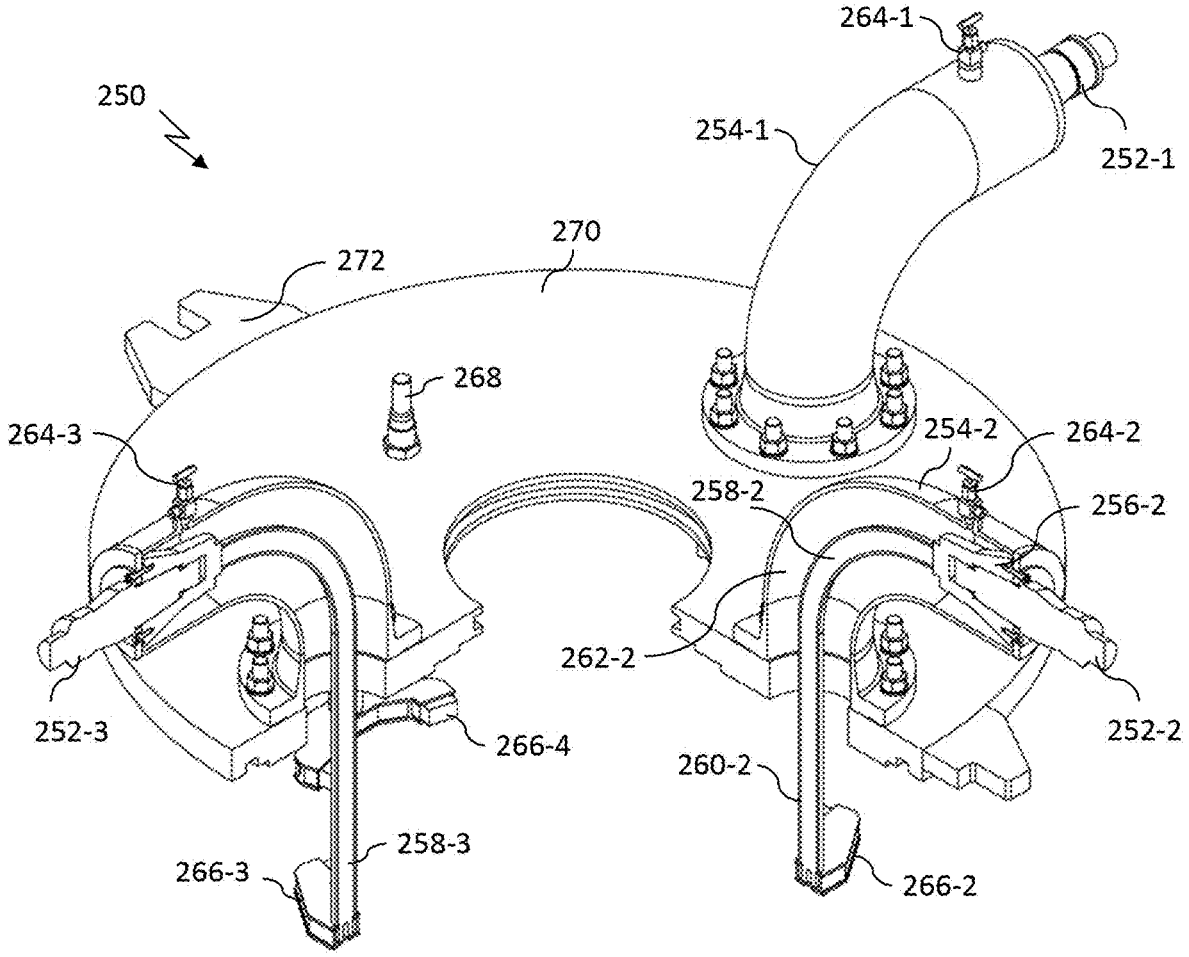
FIGS. 9 and 10 illustrate, in perspective and in longitudinal cross-section, respectively, the mobile part of the electrical swivel shown in FIG. 2.
Figure 10:
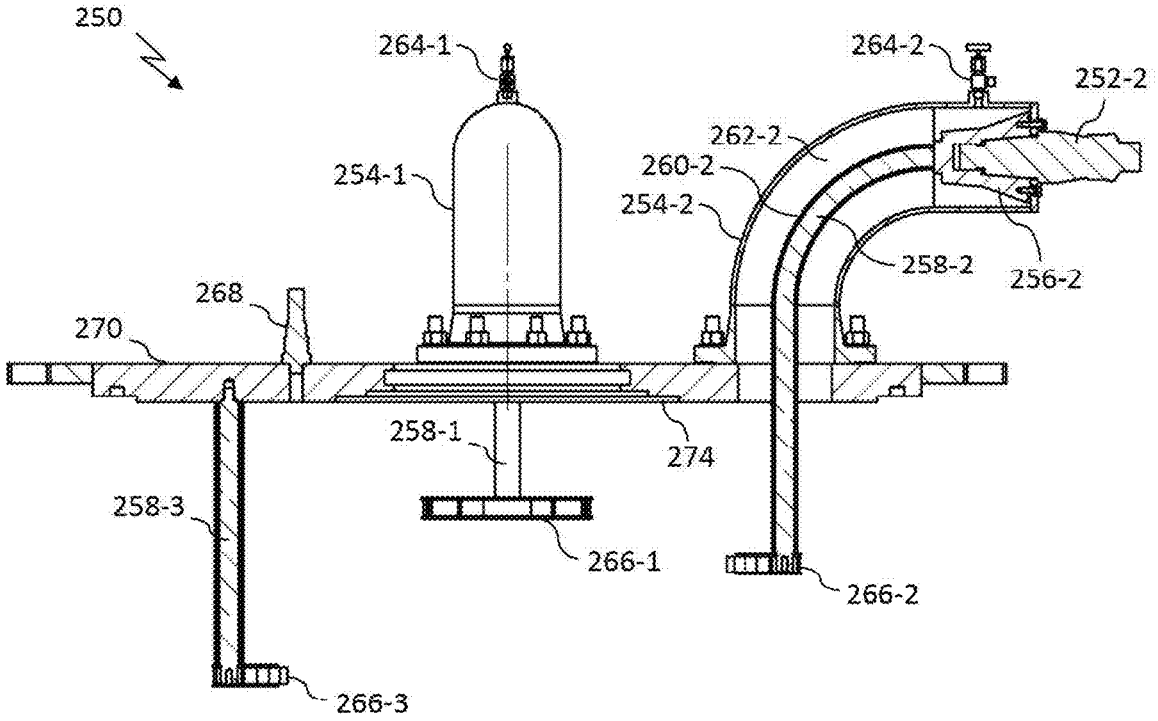

FIGS. 9 and 10 illustrate, in perspective and in longitudinal cross-section, respectively, the mobile part 250 of the electrical swivel 200 shown in FIG. 2.

As described above, the mobile part 250 comprises in particular three connectors 252-1 to 252-3, each connector being mounted on a connector mounting, which is advantageously hollow and protecting a conducting preferably provided with an insulating sheath. A space, in communication with the internal chamber 202 of the electrical swivel, is arranged between the conductor or the insulating sheath and the wall of the connector mountings.

By way of illustration, the connector 252-2 is mounted on the connector mounting 254-2 by means of the insulating ring 256-2. The connector is electrically linked to the conductor 258-2 provided with an insulating sheath 260-2. The space 262-2 is in communication with the internal chamber 202. The connector mounting 254-2 is mechanically connected to the mobile part 250, for example using bolts (as shown).

Still according to a particular embodiment, the mobile part comprises one or more valves for venting and/or filling. According to the example illustrated in FIGS. 9 and 10, each connector mounting comprises a valve for venting and/or filling. Thus, as illustrated, the connector mounting 254-1 comprises the valve for venting and/or filling 264-1, the connector mounting 254-2 comprises the valve for venting and/or filling 264-2 and the connector mounting 254-3 comprises the valve for venting and/or filling 264-3.

Again, the valves for venting and/or filling are advantageously positioned so as to correspond, at the time of a venting or filling operation, to the highest or lowest positions of the cavity formed by the internal chamber of the electrical swivel and the spaces of the connector mountings, in order to optimize the venting or the filling.

Similarly, these venting and/or filling valves are advantageously secured and/or are provided with a detection mechanism making it possible to signal, for example with an audible signal, an open position to advise of any gas leakage.

As illustrated, the connector 252-2 is electrically linked, via the conductor 258-2, to one or more brushes of one or more brush assemblies 266-2 configured to be in contact with the conducting track 224-2. Similarly, the connector 252-3 is electrically connected, via the conductor 258-3, to one or more brushes of one or more brush assemblies 266-3 configured to be in contact with the conducting track 224-3. Similarly too, the connector 252-1 is electrically linked, via the conductor 258-1 (not shown), to one or more brushes (not shown) configured to be in contact with the conducting track 224-1.

As illustrated in FIG. 9, the mobile part 250 comprises one or more brush assemblies 266-4, electrically linked to a conducting member of the mobile part 210, configured to be in contact with the conducting track 224-4 in order to establish an electrical contact between a conducting member and the fixed part 210 and a conducting member of the mobile part 250 to establish an electrical ground In the interest of clarity, it is considered here that the brush assemblies, generically referenced 266, are, with the exception of the brush assembly or assemblies used to establish a ground, fastened to the mobile part 250 via the conductors generically referenced 258 (which thus have a structural role) and the connector mountings generically referenced 254. It should however be noted that mountings for brush assemblies, which are electrically insulating, may be used to directly or indirectly fasten the brush assemblies to particular members of the mobile part 250, for example to the body 270 of the mobile part 250.

The mobile part 250 further preferably comprises one or more sensors 268. This or these sensors have the purpose of measuring parameters relative to the quality of the gas with which the electrical swivel 200 is filled. They may, for example, be pressure sensors, temperature sensors, humidity sensors and/or density sensors. Specific sensors may be used to measure each parameter. It is also possible to use multifunction sensors, sensors measuring a same parameter with different accuracies, redundant sensors, etc.

Alternatively or on a complementary basis, the fixed part 210 may comprise this or these sensors or one or more other similar sensors.

The measured data are sent to a local or remote computer (not shown) to be stored and/or analyzed in order to warn, if applicable, an operator.

As illustrated, the body 270 of the mobile part 250 preferably comprises one or more fastening members 272 configured for fastening the electrical swivel to an external structure (not shown).

The body 270 of the mobile part 250 is here a solid of revolution. It comprises a central cavity 274 configured to cooperate with the mechanism 204 in order to provide the rotation of the central part 250 relative to the fixed part 210.

Figure 11B:
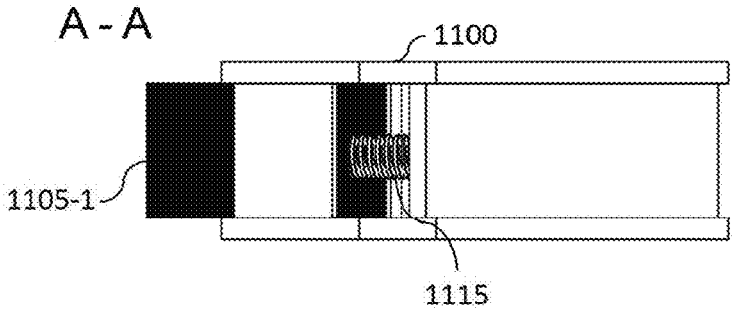
FIGS. 11*a*, 11*b* and 11*c*, illustrates an example of a brush assembly viewed in perspective, from the side and from above when it is in contact with a conducting track, respectively.
Figure 11A:
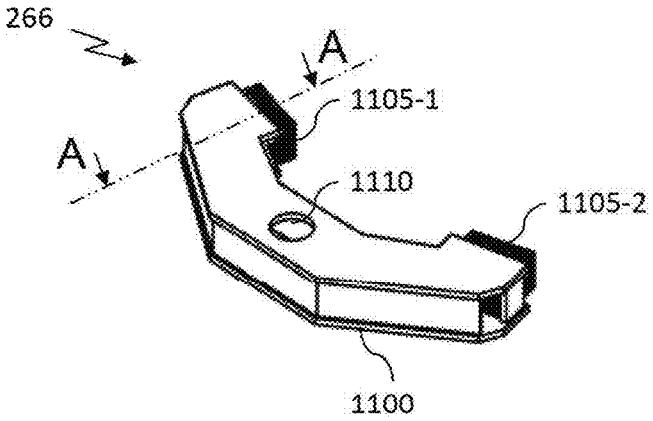
Figure 11C:
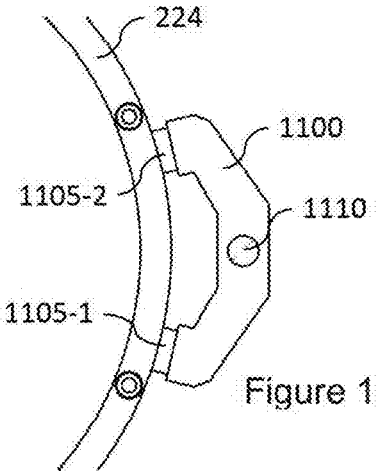

FIG. 11, comprising FIGS. 11*a*, 11*b* and 11*c*, illustrates an example of a brush assembly viewed in perspective, from the side and from above when it is in contact with a conducting track, respectively.

In general terms, a brush assembly serves to establish an electrical connection between a fixed part and a mobile part, typically rotary, by means of friction. A brush assembly generally comprises one or more graphite-based members, called brushes, and a structure typically of copper to bear them and provide an electrical connection.

As illustrated in FIG. 11*a*, a brush assembly 266 here comprises a C-shaped or circular arc-shaped body 1100 as well as two brushes 1105-1 and 1105-2 located at each end of the body. The body 1100 comprises a fastening means 1110 such as an opening, enabling it to be fastened, for example to a conductor having a structural role. The fastening means preferably allows a rotational movement of the body around an axis perpendicular to the plane comprising a conducting track with which the brush assembly must cooperate to optimize the electrical contact of each of the brushes 1105-1 and 1105-2 with that conducting track. As illustrated in FIG. 11*c*, the presence of two brushes thus makes it possible to balance the forces and without introducing a torque effect.

The brush assemblies are advantageously provided with a play compensating mechanism to, in particular, compensate for the wear of the brushes. As illustrated in FIG. 11*b*, such a mechanism may comprise an elastic member 1115 such as a spring bearing on the body 1100, maintaining the brush contact with the conducting track when the brush assembly is in a use position. The brush assembly may also comprise a retaining mechanism (not shown) to retain the brushes when the brush assembly is not in a use position.

Figure 12:
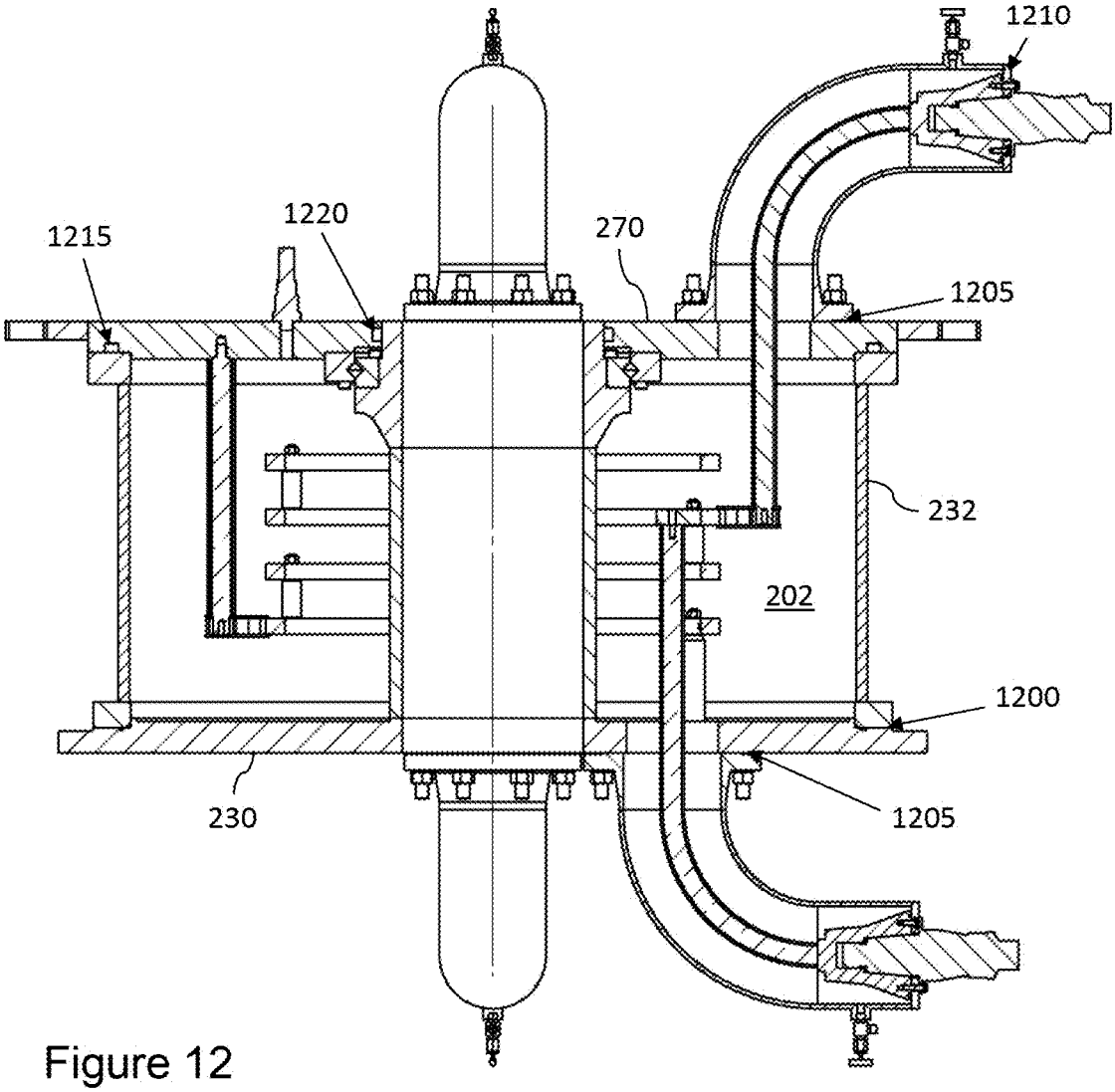
FIG. 12 is a cross-section view of the electrical swivel example illustrated in FIG. 2.

FIG. 12 is a cross-section view of the example electrical swivel illustrated in FIG. 2, that is to say a cross-section view of the mobile parts 210 and 250 assembled.

In order to avoid polluting the internal chamber 202 of the electrical swivel 200 by its environment and vice-versa, the electrical swivel is equipped with static and dynamic seals.

In particular, a seal 1200 is positioned here between the internal component 230 and the external component 232 of the body of the fixed part 210. Such a seal is for example of the 'O' ring type seal of elastomer material. As the components 230 and 232 are mechanically connected to each other, the seal 1200 is a static seal.

Similarly, a static seal of the same nature or different nature, generically referenced 1205, is positioned between each connector mounting and the member on which that mounting is fastened (i.e. the body 270 of the mobile part 250 or the internal component 230 of the fixed part 210).

Similarly, a static seal of the same nature or different nature, generically referenced 1210, is positioned between each connector mounting and the corresponding assembly formed from a connector of the associated insulating ring.

The electrical swivel 200 furthermore comprises dynamic seals to provide sealing between the fixed part 210 and the mobile part 250, in particular dynamic seals 1215 and 1220. The dynamic seal 1215 provides sealing between the peripheral edge of the body of the mobile part 250 and the upper edge of the external part 232 while the dynamic seal 1220 provides sealing between the inside edge of the body of the mobile part 250 and the central part of the internal part 230. Other configurations are possible.

Such a dynamic seal is for example of the V-shaped type seal made from material such as PTFE (standing for polytetrafluoroethylene).

As the operating efficiency of an electrical swivel according to the invention is in particular linked to the filling of the internal chamber by the gas having the required characteristics, in particular as regards its dielectric strength, it is preferable to ensure optimal filling thereof, in particular of the highest parts.

For these purposes, after having obtained the gas to use for the filling of the internal chamber of the electrical swivel, a filling method is employed. It comprises a step of injecting this gas under pressure by one or more high points of the electrical swivel and of removing the air or the gas previously contained in the internal chamber by one or more other high points of the electrical swivel. The filling is carried out in a fluid-tight and safe manner to avoid injecting gas located outside the electrical swivel into the internal chamber.

The method for venting an electrical swivel according to the invention comprises the opening of one or more lower valves (situated at low points of the electrical swivel), enabling the recovery of the gas contained in the internal chamber and the opening of one or more upper valves (situated at low points of the electrical swivel) to enable the gas (for example ambient air) to replace for the vented gas. It also comprises the recovery, by the lower valve or valves, in a secure and fluid-tight manner, of the gas filling the internal chamber of the electrical swivel.

Naturally, to satisfy specific needs, the skilled person will be able to apply modifications to the preceding description. The present invention is not limited to the described embodiments, other variants and combinations of features are possible.

The present invention has been described and illustrated in the present detailed description with reference to the appended Figures. However, the present invention is not limited to the embodiments presented. Other variants and embodiments may be deduced and implemented by the person competent in the field of the invention on reading the present description and appended Figures.

In the claims, the terms "comprise" or "include" do not exclude other elements or other steps. The indefinite article "a" does not exclude the plural. A single processor or several other units may be used to implement the invention. The different features presented and/or claimed may advantageously be combined. Their presence in the description or in different dependent claims, does not indeed exclude the possibility of combining them. The reference signs are not to be understood as limiting the scope of the invention.

The invention claimed is:

1. A high-voltage electrical swivel (200) comprising:

a first part and a second part (210, 250), which are mobile relative to each other and form a closed internal chamber (202), each of the two parts comprising at least one electrical connector (212, 252);

at least one electrical track (224) electrically linked to a connector of one of the two parts and at least one brush assembly (266) electrically linked to a connector of the other of the two parts, the at least one brush assembly cooperating with the at least one electrical track to establish an electrical contact, the at least one electrical track and the at least one brush assembly being housed in the closed internal chamber;

the closed internal chamber (202) being filled with a dielectric insulating gas having a dielectric strength greater than that of the air surrounding the electrical swivel.

2. The electrical swivel according to claim 1, wherein the electrically insulating gas has a dielectric strength greater than 40 kV/mm at operating pressure.

3. The electrical swivel according to claim 2, wherein the electrically insulating gas comprises at least one of the following gases:

a gas of the fluoronitrile family, sulfur hexafluoride, and trifluoroiodomethane.

4. The electrical swivel according to claim 1, further comprising at least one connector mounting (214, 254) of cylindrical form of which an interior part opens onto the closed internal chamber, one of the electrical connectors being mounted on the at least one connector mounting.

5. The swivel according to claim 4, further comprising at least one valve (234, 264) for venting and/or filling mounted on the at least one connector mounting.

6. The swivel according to claim 5, wherein the at least one valve for venting and/or filling comprises a safety means for indicating an open position.

7. The swivel according to claim 1, further comprising at least one conductor electrically linking at least one connector to at least one brush.

8. The swivel according to claim 7, wherein the at least one conductor holds the brush assembly in a predetermined position.

9. The swivel according to claim 1, further comprising at least one sensor (268) allowing values to be measured of at least one parameter relative to the quality of the dielectric insulating gas with which the swivel is filled.

10. The swivel according to claim 1, wherein the first part comprises at least one first electrical track electrically linked to at least one electrical connector of the first part and at least one second electrical track electrically linked to at least one grounding member of the first part, and wherein the second part comprises at least one first brush assembly electrically linked to at least one electrical connector of the second part, cooperating with the at least one first conducting track to establish an electrical contact, and at least one second brush assembly electrically linked to at least one grounding member of the second part, cooperating with the at least one second conducting track to establish an electrical contact.

11. The electrical swivel according to claim 2, further comprising at least one connector mounting (214, 254) of cylindrical form of which an interior part opens onto the closed internal chamber, one of the electrical connectors being mounted on the at least one connector mounting.

12. The electrical swivel according to claim 3, further comprising at least one connector mounting (214, 254) of cylindrical form of which an interior part opens onto the closed internal chamber, one of the electrical connectors being mounted on the at least one connector mounting.

13. The swivel according to claim 2, further comprising at least one conductor electrically linking at least one connector to at least one brush.

14. The swivel according to claim 3, further comprising at least one conductor electrically linking at least one connector to at least one brush.

15. The swivel according to claim 4, further comprising at least one conductor electrically linking at least one connector to at least one brush.

16. The swivel according to claim 5, further comprising at least one conductor electrically linking at least one connector to at least one brush.

17. The swivel according to claim 6, further comprising at least one conductor electrically linking at least one connector to at least one brush.

18. The swivel according to claim 2, further comprising at least one sensor (268) allowing values to be measured of at least one parameter relative to the quality of the dielectric insulating gas with which the swivel is filled.

19. The swivel according to claim 3, further comprising at least one sensor (268) allowing values to be measured of at least one parameter relative to the quality of the dielectric insulating gas with which the swivel is filled.

20. The swivel according to claim 4, further comprising at least one sensor (268) allowing values to be measured of at least one parameter relative to the quality of the dielectric insulating gas with which the swivel is filled.

* * * * *